US009085841B2

(12) United States Patent
Noguchi et al.

(10) Patent No.: US 9,085,841 B2
(45) Date of Patent: Jul. 21, 2015

(54) NEEDLE THREADING DEVICE AND OPERATION UNIT THEREFOR

(71) Applicants: Kotobuki & Co., Ltd., Kawagoe-shi (JP); Westek International Corporation, Tokyo (JP)

(72) Inventors: Yoshio Noguchi, Kawagoe (JP); Tomoaki Suzuki, Kawagoe (JP)

(73) Assignees: KOTOBUKI & CO., LTD., Kawagoe-Shi, Saitama (JP); WESTEK INTERNATIONAL CORPORATION, Tokyo (JP)

( * ) Notice: Subject to any disclaimer, the term of this patent is extended or adjusted under 35 U.S.C. 154(b) by 308 days.

(21) Appl. No.: 13/712,827

(22) Filed: Dec. 12, 2012

(65) Prior Publication Data

US 2013/0152837 A1 Jun. 20, 2013

(30) Foreign Application Priority Data

Dec. 15, 2011 (JP) ..... 2011-274920

(51) Int. Cl.
*D05B 87/00* (2006.01)
*D05B 87/02* (2006.01)

(52) U.S. Cl.
CPC ..... *D05B 87/00* (2013.01); *D05B 87/02* (2013.01)

(58) Field of Classification Search
CPC ..... D05B 87/02
USPC ..... 112/224, 225, 227; 223/99
See application file for complete search history.

(56) References Cited

U.S. PATENT DOCUMENTS

| | | | | |
|---|---|---|---|---|
| 3,968,761 | A * | 7/1976 | Tarrants | 112/225 |
| 4,355,591 | A * | 10/1982 | Itoh et al. | 112/225 |
| 6,045,016 | A * | 4/2000 | Okada | 223/99 |
| 6,761,121 | B2 * | 7/2004 | Kotaki | 112/225 |
| 2010/0206206 | A1 | 8/2010 | Chang | |
| 2011/0000414 | A1 | 1/2011 | Noguchi et al. | |

FOREIGN PATENT DOCUMENTS

| | | |
|---|---|---|
| EP | 1 388 602 A2 | 2/2004 |
| GB | 664475 A | 1/1952 |

(Continued)

OTHER PUBLICATIONS

European Search Report dated Feb. 11, 2014.

(Continued)

*Primary Examiner* — Tejash Patel
(74) *Attorney, Agent, or Firm* — McGinn IP Law Group, PLLC,

(57) ABSTRACT

A needle threading device is disclosed which comprises a first mechanism having a hole for receiving a needle and a slit for receiving a thread, a second mechanism having a threader pin and pivotally supported by the first mechanism so as to be pivotable between a first position and a second position different from the first position, the threader pin enabling the thread to pass through an eye of the needle when the second mechanism is pivoted to the second position from the first position, a first biasing member urging the second mechanism to the first position, an operating member causing the second mechanism to be pivoted to the second position against an action of the first biasing member, and a second biasing member urging the operating member and the second mechanism in a direction in which they are spaced away from each other.

10 Claims, 12 Drawing Sheets

(56) References Cited

FOREIGN PATENT DOCUMENTS

| | | | |
|---|---|---|---|
| GB | 948660 | A | 2/1964 |
| JP | 11-000491 | A | 1/1999 |
| JP | 3315364 | B2 | 8/2002 |
| WO | WO 2009/113529 | | 9/2009 |
| WO | WO2009/113529 | A1 | 9/2009 |

OTHER PUBLICATIONS

European Search Report dated Sep. 24, 2013.
European Search Report dated Jun. 5, 2013.
European Examination Report dated Feb. 11, 2014.

* cited by examiner

NEEDLE THREADING DEVICE AND OPERATION UNIT THEREFOR

FIELD OF THE INVENTION

The present invention relates to a needle threading device in which a threader pin is moved to enable a thread to easily pass through an eye of a needle, and also relates to an operation unit for the needle threading device.

DESCRIPTION OF THE RELATED ART

As needle threading devices of this type, there have been known needle threading devices which are disclosed in Japanese Patent No. 3315364 (Patent Literature 1), Japanese Patent Application Laid-Open Publication No. 11-491 (Patent Literature 2) and WO 2009/113529 (Patent Literature 3).

The needle threading device disclosed in the Patent Literature 1 comprises a needle insertion hole in which a needle is to be inserted, a thread insertion hole which extends so as to intersect the needle insertion hole and communicates with the needle insertion hole and in which a thread is to be inserted, a thread carrying portion arranged adjacently to an entrance of the thread insertion hole, an operating member (a threading mechanism) having a thread engaging piece (a threader pin), and a pusher member for operating the operating member. In this needle threading device, when the pusher member is pushed by a user in a state where the needle is inserted in the needle insertion hole and the thread is set on the thread carrying portion, the operating member is swung. According to the swinging movement of the operating member, the thread engaging piece of the operating member is moved in such a manner that it draws the thread on the thread carrying portion into the thread insertion hole, then draws the thread into the needle insertion hole, and causes the thread to pass through an eye of the needle while passing through the eye of the needle. In this state, when a pushing force having been applied to the pusher member by the user is released, the operating member is returned to its original position by a spring. According to the returning movement of the operating member, the thread engaging piece of the operating member is moved while allowing the thread to remain passing through the eye of the needle.

The needle threading device disclosed in the Patent Literature 2 comprises a hole for receiving and supporting a needle, a through-passage which extends so as to intersect the needle supporting hole and communicates with the needle supporting hole, a thread carrying portion, an arm member (a threading mechanism) provided with a pusher button, and a thrusting member (a threader pin) connected to the arm member. When the pusher button is pushed by the user in a state where the needle is inserted in the needle supporting hole and a thread is set on the thread carrying portion, the arm member is swung. According to the swinging movement of the arm member, the thrusting member is moved in such a manner that it draws the thread on the thread carrying portion into the through-passage, then draws the thread into the needle supporting hole, and causes the thread to pass through an eye of the needle while passing through the eye of the needle. In this state, when a pushing force having been applied to the pusher button by the user is released, the arm member is returned to its original position due to a resilient force thereof. According to the returning movement of the arm member, the thrusting member is returned to its original position while allowing the thread to remain passing through the eye of the needle.

The needle threading device disclosed in the Patent Literature 3 comprises a needle receiving mechanism having a needle insertion hole and a thread insertion slit extending at an angle relative to the needle insertion hole and communicating with the needle insertion hole, a threading mechanism provided with a threader pin and swingable between a position spaced away from the needle receiving mechanism and a position approaching the needle receiving mechanism, and a switch member movable with respect to the needle receiving mechanism. In a state where a needle is inserted in the needle insertion hole and a thread is inserted in the thread insertion slit, when the threading mechanism is operated by the user so as to be swung into the position approaching the needle receiving mechanism from the position spaced away from the needle receiving mechanism, the threader pin is moved in such a manner that it draws the thread into the needle insertion hole and then causes the thread to pass through an eye of the needle in the needle insertion hole while passing through the eye of the needle. The switch member is adapted to be movable between a position in which it causes the threading mechanism to be constrained in the position approaching the needle receiving mechanism, and a position in which it allows the swinging movement of the threading mechanism between the position approaching the needle receiving mechanism and the position spaced away from the needle receiving mechanism.

SUMMARY OF THE INVENTION

However, in each of the above-mentioned needle threading devices in accordance with the related art, for example, if the threading mechanism is operated by the user so as to be swung in a situation where the needle is incorrectly located in the needle insertion hole or needle supporting hole in such a manner that the threader pin is not allowed to pass through the eye of the needle, and the threader pin approaches the needle according to the swinging movement of the threading mechanism, a tip end of the threader pin is abutted against a portion of the needle other than the eye of the needle and may not well pass through the eye of the needle. In such a case, if the operation of the threading mechanism by the user is forcedly continued, the threader pin does not withstand a load having been applied to the threader pin by the abutting of the tip end of the threader pin against the portion of the needle and may be bent and/or broken.

The present invention has been made with a view of the aforesaid background and it is an object of the present invention to provide a needle threading device in which a threader pin can be prevent from being bent and/or broken even if a tip end of the threader pin is abutted against a portion of the needle other than an eye of the needle and does not well pass through an eye of the needle.

Another object of the present invention is to provide an operation unit which is adapted to be detachably attached to a body of the needle threading device.

In accordance with a first aspect of the present invention, there is provided a needle threading device which comprises a needle receiving mechanism having a needle insertion hole for receiving a needle therein and a thread insertion slit for receiving a thread therein, the thread insertion slit extending at an angle relative to the needle insertion hole and communicating with the needle insertion slit, a threading mechanism provided with a threader pin and pivotally supported by the needle receiving mechanism so as to be pivotable between a first position and a second position different from the first position, the threader pin enabling the thread in the thread insertion slit to pass through an eye of the needle in the needle insertion hole when the threading mechanism is pivoted to the second position from the first position, a first biasing member urging the threading mechanism to the first position, an operating member causing the threading mechanism to be pivoted to the second position against an action of the first biasing member, and a second biasing member urging the operating member and the threading mechanism in a direction in which they are spaced away from each other, wherein when the operating member is operated so as to be moved in a direction in which it approaches the threading mechanism, the threading mechanism is pushed by an action of the second biasing member to be pivoted to the second position against the action of the first biasing member, and when the threading mechanism is pivoted toward the second position and the threader pin is abutted against the needle in the needle insertion hole, the pivotal movement of the threading mechanism to the second position is stopped and the operating member approaches the threading mechanism against the action of the second biasing member.

The needle threading device may include a cover encircling at least partially the needle receiving mechanism. The operating member is attached to the cover.

The cover is adapted to be movable between a constraint position in which it causes the threading mechanism to be constrained in the second position, and an allowance position in which it allows the threading mechanism to be pivoted between the first and second positions. When the cover is moved to the allowance position from the constraint position, the second biasing member is adapted to be slid on the threading mechanism according to the movement of the cover to the allowance position from the constraint position.

When the cover is moved to the allowance position, the threading mechanism is pivoted toward the first position by the action of the first biasing member and the second biasing member is elastically deformed according to the pivotal movement of the threading mechanism toward the first position.

The needle threading device may include a body. The needle receiving mechanism and the threading mechanism are housed in the body so as to be removable from the body. The cover may be detachably mounted on the body so as to be movable between the constraint position and the allowance position.

In accordance with a second aspect of the present invention, there is provided an operation unit adapted to be detachably attached to a needle threading device. The needle threading device comprises a needle receiving mechanism having a needle insertion hole for receiving a needle therein and a thread insertion slit for receiving a thread therein, the thread insertion slit extending at an angle relative to the needle insertion hole and communicating with the needle insertion slit, a threading mechanism provided with a threader pin and pivotally supported by the needle receiving mechanism so as to be pivotable between a first position and a second position different from the first position, the threader pin enabling the thread in the thread insertion slit to pass through an eye of the needle in the needle insertion hole when the threading mechanism is pivoted to the second position from the first position, and a first biasing member urging the threading mechanism to the first position. The operation unit comprises a cover encircling at least partially the needle receiving mechanism, an operating member attached to the cover for causing the threading mechanism to be pivoted to the second position against an action of the first biasing member, and a second biasing member urging the operating member and the threading mechanism in a direction in which they are spaced away from each other. When the operating member is operated so as to be moved in a direction in which it approaches the threading mechanism, the threading mechanism is pushed by an action of the second biasing member to be pivoted to the second position against the action of the first biasing member. When the threading mechanism is pivoted toward the second position and the threader pin is abutted against the needle in the needle insertion hole, the pivotal movement of the threading mechanism to the second position is stopped and the operating member approaches the threading mechanism against the action of the second biasing member.

The needle threading device according to the first aspect of the present invention exhibits the following effect. That is, when the threading mechanism is pivoted in the direction in which the threading mechanism approaches the needle receiving mechanism, and the threader pin of the threading mechanism approaches the needle in the needle insertion hole according to the pivotal movement of the threading mechanism, if a tip end of the threader pin is contacted with a portion of the needle other than the eye of the needle and cannot pass through the needle eye, the second biasing member is elastically deformed, thereby making it possible to absorb a load having been applied to the threader pin by the contacting of the tip end of the threader pin with the portion of the needle. Therefore, by the absorption of the load, it is possible to prevent the threader pin from being bent and/or broken.

The operation unit according to the second aspect of the present invention exhibits the following effect. That is, a cover with which a needle threading device is provided and which does not have a threader pin-breakage preventing function is replaced with the operation unit according to the second aspect of the present invention having the threader pin-breakage preventing function as discussed above, thereby making it possible to additionally give the threader pin-breakage preventing function to the needle threading device. Vice versa is also possible.

These and other objects and many of the attendant advantages of the present invention will be readily appreciated as the same becomes better understood by reference to the following detailed description when considered in connection with the accompanying drawings.

LIST OF REFERENCE SIGNS

Figure 1:
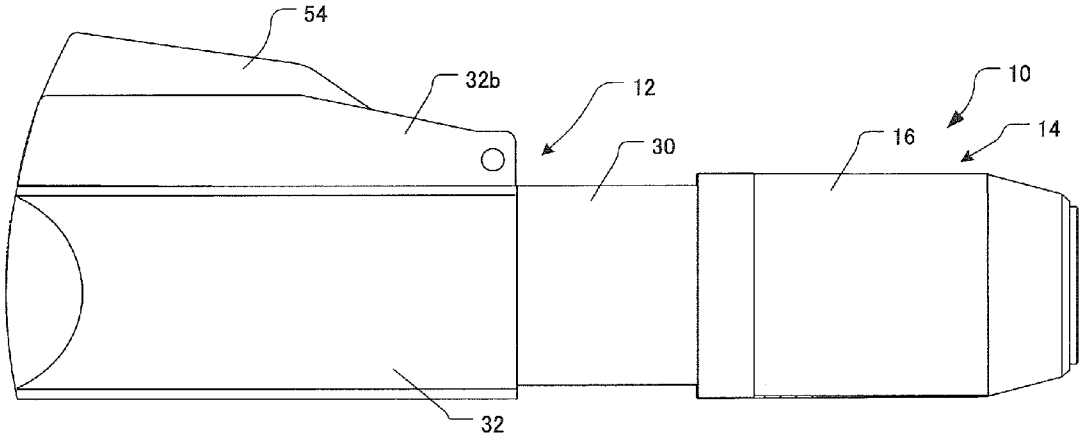
FIG. 1 is a schematic outline view showing a needle threading device, at the time when being housed, according to an embodiment of the present invention.

10: Needle threading device
30: Body
32: Cover
34: Needle receiving mechanism
34*c*: Needle insertion hole
34*e*: Thread insertion slit
42: Threading mechanism
48*b*: Threader pin
50: First biasing member
54: Operating member
56: Second biasing member
70: Needle
70*a*: Needle eye
72: Thread

DETAILED DESCRIPTION OF THE EMBODIMENT

An embodiment of the present invention will be discussed hereinafter with reference to the accompanying drawings.

Figure 2:
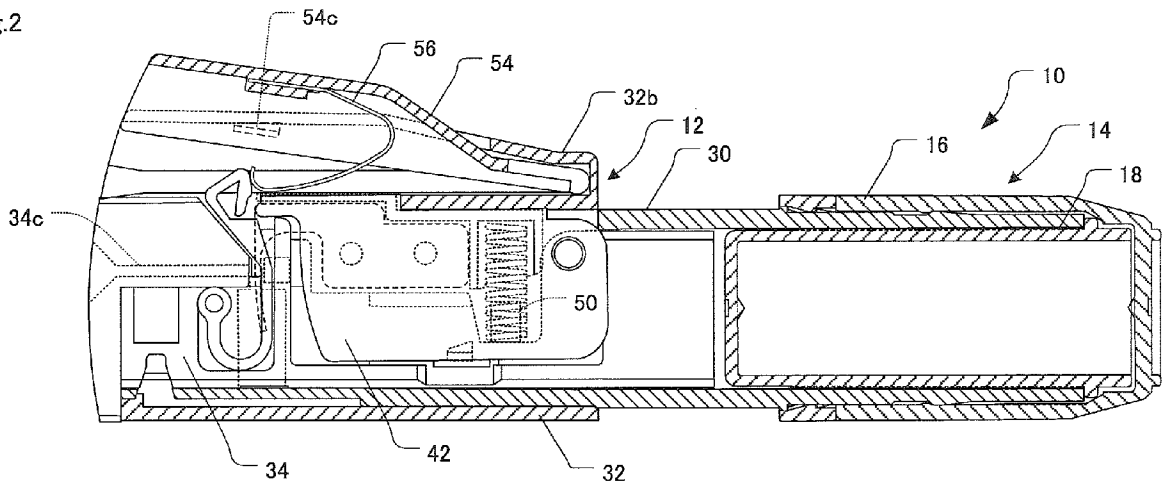
FIG. 2 is a schematic longitudinal sectional view of the needle threading device of FIG. 1 at the time when being housed.
Figure 3:
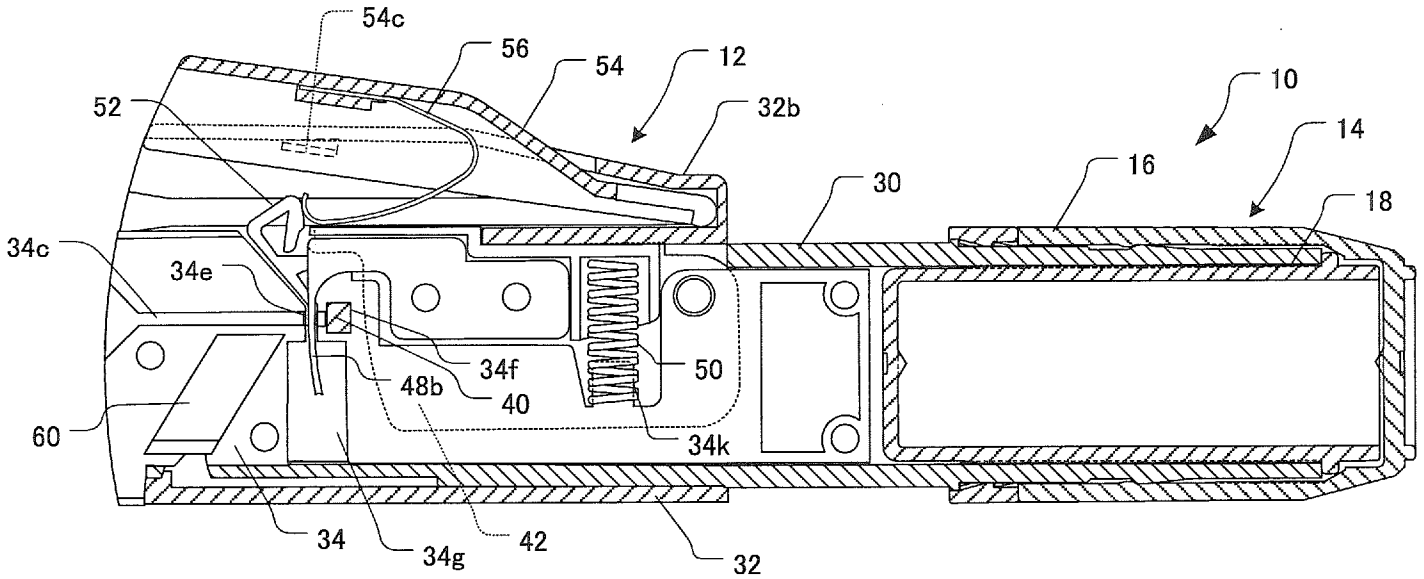
FIG. 3 is a schematic longitudinal sectional view showing an internal structure of the needle threading device of FIG. 1 at the time when being housed.

Referring to FIGS. 1-3, a needle threading device 10 according to an embodiment of the present invention has entirely a longitudinal structure which includes a needle threading unit 12 provided on one end side of the longitudinal structure and a storage unit 14 provided on the other end side of the longitudinal structure. The needle threading unit 12 and the storage unit 14 are integrally connected to each other in an axial direction of the longitudinal structure.

The needle threading unit 12 comprises a substantially cylindrical body 30 shared by a body of the storage unit 14, an internal mechanism unit 33 (see FIG. 4), and an operation unit. A substantially cylindrical-shaped cover 32 is slidably mounted on the cylindrical body 30 so as to be axially slidably within a predetermined range with respect to the cylindrical body 30.

The storage unit 14 comprises a case 18 defining a storage space in the body 30, and a cap 16 removably mounted on end portions of the body 30 and case 18. By detaching the cap 16 from the body 30 and the case 18, for example, embroidery needles, sewing needle, and the like can be stored in the case 18.

Incidentally, in the following explanation, a side of the needle threading unit 12 which is adjacent to the storage unit 14 shall be conveniently referred to as a rear end side and the opposite side of the needle threading unit 12 shall be conveniently referred to as a tip end side.

Figure 4:
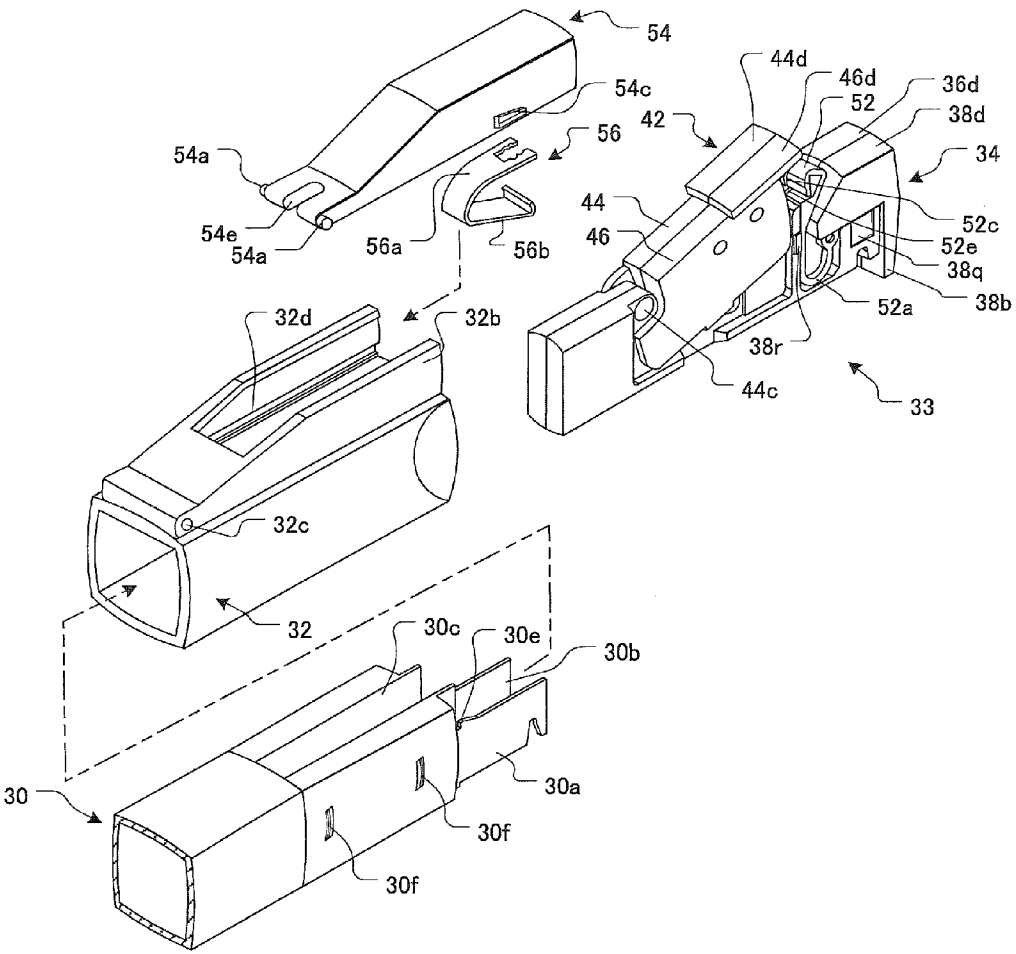
FIG. 4 is a schematic exploded perspective view of the needle threading device shown in FIG. 1.
Figure 6:
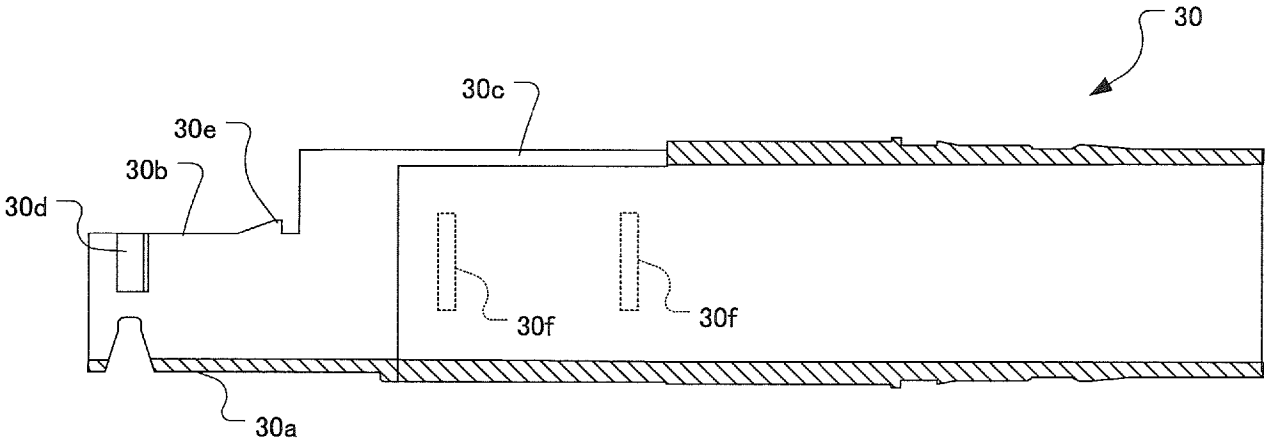
FIG. 6 is a schematic longitudinal sectional view of a body of the needle threading device shown in FIG. 1.

Referring to FIGS. 4 and 6, the body 30 is formed into a rectangular cylindrical-shape and has an axially extending opening portion 30*c* formed in an upper portion thereof. The body 30 is provided on a tip end side thereof with an elongated section 30*a* that has an upward facing U-shape in cross-section. The elongated section 30*a* has a width narrower than that of the body 30 and includes a pair of opposing side plates whose tip end portions have heights lower than those of rear end portions of the opposing side plates. An upward facing opening-portion 30*b* of the elongated section 30*a* has a width substantially equal to that of the axially extending opening portion 30*c* of the body 30 and communicates with the axially extending opening portion 30*c* of the body 30. Moreover, each of the side plates of the elongated section 30*a* is provided on an inner surface of a tip end portion thereof with an engaging protrusion 30*d* and provided on an upper part of a region adjacent to a rear end portion thereof with an engaging protrusion 30*e*.

The internal mechanism unit 33 comprises a needle receiving mechanism 34 and a threading mechanism 42 and is inserted in the body 30 through the opening portion 30*b* of the elongated section 30*a* of the body 30 and the axially extending opening portion 30*c* of the body 30 and fixed to the body 30.

Figure 5:
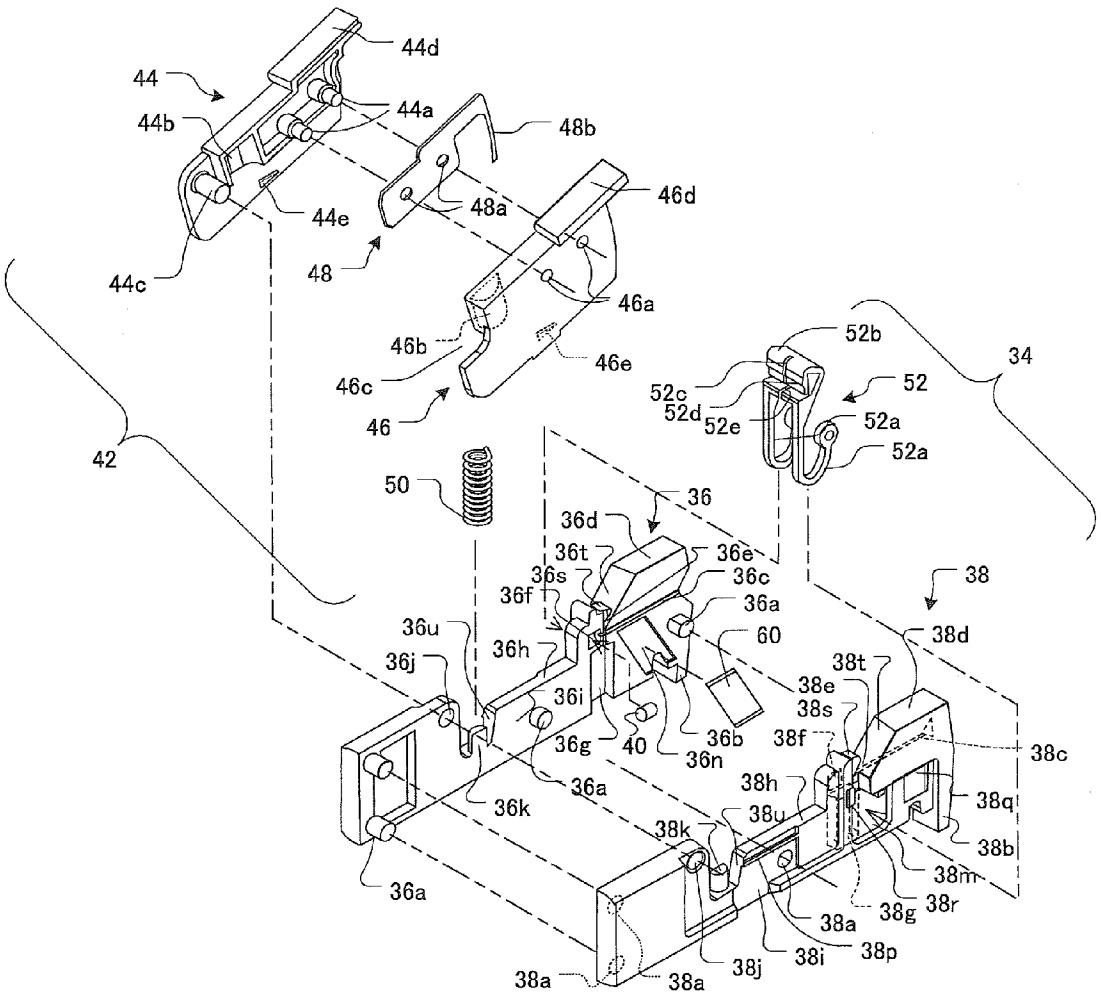
FIG. 5 is a schematic exploded perspective view of an internal mechanism unit of the needle threading device shown in FIG. 1.

Referring to FIG. 5, the needle receiving mechanism 34 comprises a pair of first and second needle receiving members 36, 38 formed substantially symmetrically with respect to each other, and a protective cover 52 attached to the first and second needle receiving members 36, 38 for protecting a threader pin 48*b* of the threading mechanism 42 which will be discussed in greater detail hereinafter. The first needle receiving member 36 and the second needle receiving member 38 include a thin plate-shaped body 36*i* and a thin plate-shaped body 38*i*, respectively. The plate-shaped body 36*i* of the first needle receiving member 36 has a plurality of engaging protrusions 36*a*. The plate-shaped body 38*i* of the second needle receiving member 38 is formed with a plurality of engaging holes 38*a*. The first and second needle receiving members 36, 38 are combined with each other by causing the engaging protrusions 36*a* of the first needle receiving member 36 to be fitted into the engaging holes 38*a* of the second needle receiving member 38, and the protective cover 52 is attached to the combined needle receiving members 36, 38, whereby the needle receiving mechanism 34 is assembled.

The plate-shaped body 36*i* of the first needle receiving member 36 is provided at a tip end portion thereof with a downward protruding flange portion 36*b*. Similarly, the plate-shaped body 38*i* of the second needle receiving member 38 is provided at a tip end portion thereof with a downward protruding flange portion 38*b*. When the needle receiving mechanism 34 that has been assembled by causing the needle receiving members 36, 38 to be combined with each other and attaching the protective cover 52 to the combined needle receiving members 36, 38 is inserted into the body 30, the flange portions 36*b*, 38*b* are engagedly abutted against a tip end surface of the elongated section 30*a* of the body 30.

Moreover, the plate-shaped body 36*i* of the first needle receiving member 36 has an elongated groove portion 36*c* formed in an inner surface thereof that is opposed to an inner surface of the plate-shaped body 38*i* of the second needle receiving member 38 when the first and second needle receiving members 36, 38 are combined with each other. The elongated groove portion 36*c* extends rearward from a tip end edge of the plate-shaped body 36*i* of the first needle receiving member 36. Similarly, the plate-shaped body 38*i* of the second needle receiving member 38 has an elongated groove portion 38*c* formed in the inner surface thereof. The elongated groove portion 38*c* of the second needle receiving member 38 extends rearward from a tip end edge of the plate-shaped body 38*i* of the second needle receiving member 38. When the first and second needle receiving members 36, 38 are combined with each other, the elongated groove portions 36*c*, 38*c* define a needle insertion hole 34*c* (refer to FIG. 3) in which a needle is to be inserted.

Moreover, the plate-shaped body 36*i* of the first needle receiving member 36 has an upward protruding portion 36*d* formed on a top surface of the tip end portion thereof. Similarly, the plate-shaped body 38*i* of the second needle receiving member 38 has an upward protruding portion 38*d* formed on a top surface of the tip end portion thereof. When the needle receiving mechanism 34 is inserted in the body 30, the protruding portions 36*d*, 38*d* are located upward of the opening portion 30*b* of the elongated section 30*a* of the body 30. Moreover, when the first and second needle receiving members 36, 38 are combined with each other, a slight clearance is provided between opposed inner surfaces of the protruding portions 36*d*, 38*d*. The clearance between the protruding portions 36*d*, 38*d* communicates with the needle insertion hole 34*c*. When the needle through whose eye a thread has been inserted by the needle threading device 10 according to the present invention as will be hereinafter discussed in greater detail is removed from the needle threading device 10, the thread is allowed to pass the clearance between the protruding portions 36*d*, 38*d* Moreover, the plate-shaped body 36*i* has a receiving portion 36*s* provided on the top surface of the tip end portion thereof so as to be arranged adjacently to a rear end side of the protruding portion 36*d*. Similarly, the plate-shaped body 38*i* has a receiving portion 38*s* provided on the top surface of the tip end portion thereof so as to be arranged adjacently to a rear end side of the protruding portion 38*d*. When the first and second needle receiving members 36, 38 are combined with each other, a slight clearance through which the threader pin 48*b* briefly discussed above is adapted to be inserted is provided between opposed surfaces of the receiving portions 36*s*, 38*s*.

The rear end side of the protruding portion 36*d* of the first needle receiving member 36 is formed so as to have a slanted surface 36*t*. Similarly, the rear end side of the protruding portion 38*d* of the second needle receiving member 38 is formed so as to have a slanted surface 38*t*. Moreover, the protruding portion 36*d* has a vertical surface which extends vertically from a rear end edge of the slanted surface 36*t* and is substantially perpendicular to the elongated groove portion 36*c*. Similarly, the protruding portion 38*d* has a vertical surface which extends vertically from a rear end edge of the slanted surface 38*t* and is substantially perpendicular to the elongated groove portion 38*c*. A surface of the receiving portion 36*s* of the first needle receiving member 36 which is adjacent to the protruding portion 36*d* has a shape substantially corresponding to a shape which consists of a shape of the slanted surface 36*t* and a shape of the vertical surface of the protruding portion 36*d*. Similarly, a surface of the receiving portion 38*s* of the second needle receiving member 38 which is adjacent to the protruding portion 38*d* has a shape substantially corresponding to a shape which consists of a shape of the slanted surface 38*t* and a shape of the vertical surface of the protruding portion 38*d*. The slanted surface 36*t* and vertical surface of the protruding portion 36*d* and the surface of the receiving portion 36*s* define a slit 36*e* which vertically extends from the top surface of the plate-shaped body 36*i* to a rear end of the elongated groove portion 36*c*. More particularly, the slit 36*e* vertically extends between the protruding portion 36*d* and the receiving portion 36*s* and communicates with the elongated groove portion 36*c*. Similarly, the slanted surface 38*t* and vertical surface of the protruding portion 38*d* and the surface of the receiving portion 38*s* define a slit 38*e* which vertically extends from the top surface of the plate-shaped body 38*i* to a rear end of the elongated groove portion 38*c*. More particularly, the slit 38*e* vertically extends between the protruding portion 38*d* and the receiving portion 38*s* and communicates with the elongated groove portion 38*c*. When the first and second needle receiving members 36, 38 are combined with each other, the slits 36*e*, 38*e* define a thread insertion slit 34*e* (see FIG. 3) which is perpendicular to and communicates with the needle insertion hole 34*c* and in which the thread is to be inserted. Moreover, the plate-shaped body 36*i* of the first needle receiving member 36 is formed in the inner surface thereof with a first recess portion 36*g* which communicates with the slit 36*e* and extends downward from a lower end of the slit 36*e*. Similarly, the plate-shaped body 38*i* of the second needle receiving member 38 is formed in the inner surface thereof with a first recess portion 38*g* which communicates with the slit 38*e* and extends downward from a lower end of the slit 38*e*. When the first and second needle receiving members 36, 38 are combined with each other, the first recess portion 36*g* of the first needle receiving member 36 and the first recess portion 38*g* of the second needle receiving member 38 define a through-hole 34*g* (see FIG. 3) in which a tip end portion of the threader pin 48*b* of the threading mechanism 42 is adapted to be operatively inserted when the needle threading mechanism 42 is operated as will be discussed hereinafter.

Moreover, the plate-shaped body 36*i* has a housing recess portion 36*f* formed in the inner surface thereof so as to be arranged adjacently to the rear end of the elongated groove portion 36*c* and communicating with the elongated groove portion 36*c*, and the plate-shaped body 38*i* has a housing recess portion 38*f* formed in the inner surface thereof so as to be arranged adjacently to the rear end of the elongated groove portion 38*c* and communicating with the elongated groove portion 38*c*. When the first and second needle receiving member 36, 38 are combined with each other, the housing recess portion 36*f* of the first needle receiving member and the housing recess portion 38*f* of the second needle receiving member 38 define a magnet housing portion 34*f* (see FIG. 3) in which a magnet 40 is housed. Moreover, an outer surface of the plate-shaped body 36*i* which is opposite to the inner surface of the plate-shaped body 36*i* has a second recess portion (not shown) provided with a support portion (not shown). Similarly, an outer surface of the plate-shaped body 38*i* which is opposite to the inner surface of the plate-shaped body 38*i* has a second recess portion 38*m* provided with a support portion (not shown). As will be hereinafter discussed in greater detail, the second recess portion (not shown) of the plate-shaped body 36*i* and the second recess portion 38*m* of the plate-shaped body 38*i* serve to support the protective cover 52. Moreover, the inner surface of the plate-shaped body 36*i* and the inner surface of the plate-shaped body 38*i* are formed with a third recess portion 36*n* and a third recess portion (not shown), respectively. When the first and second needle receiving members 36, 38 are combined with each other, the third recess portion 36*n* of the first needle receiving member 36 and the third recess portion (not shown) of the second needle receiving member 38 define a cutter housing portion (not shown) in which a cutter 60 for cutting the thread is housed.

Moreover, the outer surface of the plate-shaped body 36*i* of the first needle receiving member 36 has an engaging recess portion 36*q* (see FIG. 16) which is formed so as to be arranged adjacently to and line up with the second recess portion (not shown) of the plate-shaped body 36*i*. Similarly, the outer surface of the plate-shaped body 38*i* of the second needle receiving member 38 has an engaging recess portion 38*q* which is formed so as to be arranged adjacently to and line up with the second recess portion 38*m* of the plate-shaped body 38*i*. When the needle receiving mechanism 34 is inserted in the body 30, the engaging protrusions 30*d* of the body 30 which have been discussed above are engagedly received in the engaging recess portions 36*q*, 38*q*.

Moreover, the outer surface of the plate-shaped body 36*i* of the first needle receiving member 36 and the outer surface of the plate-shaped body 38*i* of the second needle receiving member 38 are provided with a laterally projecting engagement protrusion 36*r* (see FIG. 16) and a laterally projecting engagement protrusion 38*r*, respectively. When the needle receiving mechanism 34 is inserted in the body 30, the engagement protrusions 36*r*, 38*r* are engagedly stopped by the engaging protrusions 30*e* of the body 30 which have been discussed above.

Moreover, the plate-shaped body 36*i* of the first needle receiving member 36 has a first notch portion 36*h* and a second notch portion 36*u* which are formed in a top region of a substantially center portion of the plate-shaped body 36*i* in a longitudinal direction of the plate-shaped body 36*i*. The second notch portion 36*u* is continued from a rear end of the first notch portion 36*h* and formed in a step form. A pillar-shaped protrusion 36*k* of a substantially semicircular shape in cross-section is projected upward from a bottom surface of the second notch portion 36*u* of the plate-shaped body 36*i*. Similarly, the plate-shaped body 38*i* of the second needle receiving member 38 has a first notch portion 38*h* and a second notch portion 38*u* which are formed in a top region of a substantially center portion of the plate-shaped body 38*i* in a longitudinal direction of the plate-shaped body 38*i*. The second notch portion 38*u* is continued from a rear end of the first notch portion 38*h* and formed in a step form. A pillar-shaped protrusion 38*k* of a substantially semicircular shape in cross-section is projected upward from a bottom surface of the second notch portion 38*u* of the plate-shaped body 38*i*. When the first and second needle receiving members 36, 38 are combined with each other, the protrusions 36*k*, 38*k* form a biasing member-retaining protrusion 34K (see FIG. 3) of a substantially circular-shape in cross-section, to which a coil-shaped spring (a first biasing member) 50 is retained. Moreover, the plate-shaped body 36*i* has a bearing hole 36*j* formed in a rear end portion thereof and the plate-shaped body 38*i* also has a bearing hole 38*j* formed in a rear end portion thereof.

The protective cover 52 is attached to the combined needle-receiving members 36, 38 with a head portion 52*b* of the protective cover 52 being supported on the receiving portions 36*s*, 38*s* of the first and second needle receiving members 36, 38, with one of a pair of spaced apart leg portions 52*a*, 52*a* of the protective cover 52 being received in the second recess portion (not shown) of the first needle receiving member 36 and retained at a free end thereof to the support portion (not shown) of the second recess portion of the first needle receiving member 36, and with the other of the pair of spaced apart leg portions 52*a*, 52*a* of the protective cover 52 being received in the second recess portion 38*m* of the second needle receiving member 38 and retained at a free end thereof to the support portion (not shown) of the second recess portion 38*m* of the second needle receiving member 38. In summary, the protective cover 52 is attached to the combined needle-receiving members 36, 38, with the leg portions 52*a*, 52*a* interposing the combined needle-receiving members 36, 38 therebetween.

The protective cover 52 comprises the head portion 52*b* bent in such a manner that one end region thereof has a substantially triangle-shape in vertical-section, and the pair of spaced apart leg portions 52*a*, 52*a* provided at the other end region of the head portion 52*b* and considerably bent into U-shapes in outline. As discussed above, by causing the head portion 52*b* of the protective cover 52 to be supported on the receiving portions 36*s*, 38*s* of the first and second needle receiving members 36, 38, and causing the free end of the one of the spaced apart leg portions 52*a*, 52*a* and the free end of the other of the spaced apart leg portions 52*a*, 52*a* to be retained to the support portion (not shown) of the second recess portion (not shown) of the first needle receiving member 36 and the support portion (not shown) of the second recess portion 38*m* of the second needle receiving member 38, respectively, the protective cover 52 is attached to the first and second needle receiving members 36, 38. The leg portions 52*a* of the protective cover 52 are designed so as to exhibit elasticity, so that the protective cover 52 in the state being attached to the first and second needle receiving members 36, 38 is deformable in a forward/rearward direction. A rear surface of the substantially triangle-shaped end region of the head portion 52*a* of the protective cover 52 has a slit 52*c* vertically formed in a center portion thereof in a width direction of the head portion 52*b*. Moreover, the other end region of the head portion 52*a* of the protective cover 52 is formed with a second slit 52*e* perpendicular to the vertically extending slit 52*c* of the head portion 52*b*. In the state where the protective cover 52 is attached to the needle receiving members 36, 38, the first slit 52*c* and second slit 52*e* of the protective cover 52 are vertically aligned with the slight clearance between the opposed surfaces of the receiving portions 36*s*, 38*s* of the needle receiving members 36, 38. Moreover, a small protrusion 52*d* is protrusively formed on the one end region of the head portion 52*b* so as to extend along the width direction of the head portion 52*b*.

In the state where the protective cover 52 is attached to the first and second needle receiving members 36, 38, a clearance which communicates with the thread insertion slit 34*e* is provided between the head portion 52*b* of the protective cover 52 and the slanted surfaces 36*t*, 38*t* of the protruding portions 36*d*, 38*d* of the plate-shaped bodies 36*i*, 38*i*.

The threading mechanism 42 is pivotally supported by the needle receiving mechanism 34 structured as discussed above. The threading mechanism 42 comprises a threading member 48 provided with the threader pin 48*b* briefly discussed above, and a pair of first and second holding members 44, 46 supporting the threading member 48 so as to interpose the threading member 48 therebetween. The first and second holding members 44, 46 are formed substantially symmetrically with respect to each other and comprise substantially thin plate-shaped bodies. The threading member 48 comprises a substantially thin plate-shaped body, from an end portion of which the threader pin 48*b* hangs downward. In the state where the threading mechanism 42 is pivotally supported by the needle receiving mechanism 34, the first and second holding member 44, 46 are arranged so as to interpose the plate-shaped bodies 36*i*, 38*i* of the first and second needle receiving members 36, 38 therebetween, and the threader pin

Figure 9:
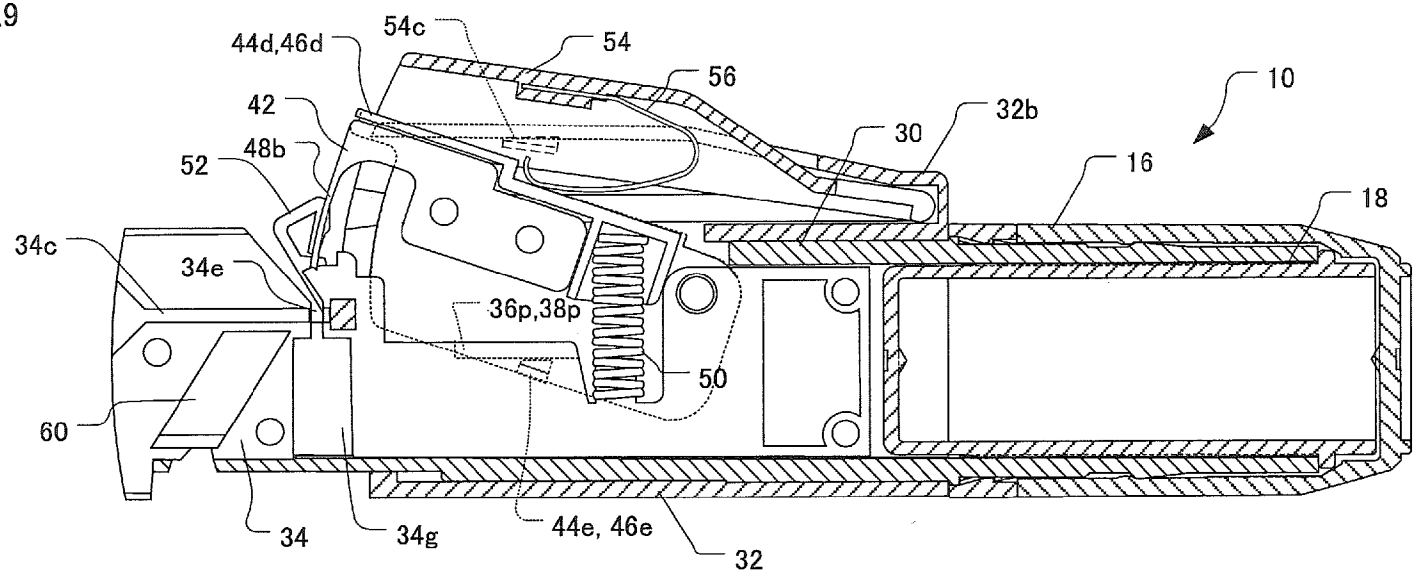
FIG. 9 is a schematic longitudinal sectional view of the needle threading device of FIG. 1 at the time when being used.

48*b* of the threading member 48 is inserted in the first slit 52*c* and second slit 52*e* of the protective cover 52 as shown in FIG. 9.

The plate-shaped body of the first holding member 44 is provided with a plurality of engagement protrusions 44*a*. The plate-shaped body of the second holding member 46 has a plurality of engagement holes 46*a* formed in regions thereof which positionally correspond to the engagement protrusions 44*a* of the first holding member 44. Similarly, the plate-shaped body of the threading member 48 has a plurality of engagement holes 48*a* formed in regions thereof which positionally correspond to the engagement protrusions 44*a* of the first holding member 44. By causing the engagement protrusions 44*a* of the first holding member 44 to be fitted through the engagement holes 48*a* of the threading member 48 and the engagement holes 46*a* of the second holding member 46, the first and second holding members 44, 46 and the threading member 48 interposed between the first and second holding members 44, 46 are combined with one another to form the threading mechanism 42. In the threading mechanism 42, the threader pin 48*b* projects outside from a clearance between the first and second holding members 44, 46.

The first holding member 44 is provided with a pivotal axis 44*c* which projects laterally from an inner surface of a rear end portion of the first holding member 44. The second holding member 46 has a notch 46*c* formed in a region thereof which positionally corresponds to the pivotal axis 44*c* of the first holding member 44. By causing the pivotal axis 44*c* of the first holding member 44 combined with the threading member 48 and the second holding member 46 to be fitted through the bearing holes 36*j*, 38*j* of the first and second needle receiving members 36, 38, the threading mechanism 42 is pivotally supported by the needle receiving mechanism 34 so as be pivotable about the pivotal axis 44*c*. Moreover, the plate-shaped body of the first holding member 44 has a rim portion extending along an upper portion thereof and the plate-shaped body of the second holding member 46 also has a rim portion extending along an upper portion thereof. The rim portions are slightly projected in an opposed direction relative to each other. A tip end region of the rim portion of the first holding member 44 is formed to have a height higher than that of a rear end region of the rim portion of the first holding member 44, so that the tip end region of the rim portion of the first holding member 44 forms an upward projecting protrusion 44*d*. Similarly, a tip end region of the rim portion of the second holding member 46 is formed to have a height higher than that of a rear end region of the rim portion of the second holding member 46, so that the tip end region of the rim portion of the first holding member 46 forms an upward projecting protrusion 46*d*. That is, each of the rim portions is formed in a step form. Moreover, the first holding member 44 has a biasing member-receiving recess portion 44*b* formed in the inner surface thereof and the second holding member 46 also has a biasing member-receiving recess portion 46*b* formed in the inner surface thereof. When the threading mechanism 42 is pivotally supported by the needle receiving mechanism 34, the biasing member-receiving recess portions 44*b*, 46*b* form a housing portion for receiving the first biasing member 50 retained to the biasing member-retaining protrusion 34*k* of the needle receiving mechanism 34. Namely, the first biasing member 50 is interposedly arranged between the needle receiving mechanism 34 and the threading mechanism 42 and causes the threading mechanism 42 to be always urged in a direction in which the threading mechanism 42 is spaced away from the needle receiving mechanism 34.

In the state where the threading mechanism 42 is pivotally supported by the needle receiving member 34, the first holding member 44 and the second holding member 46 are arranged outside the plate-shaped body 36*i* of the first needle receiving member 36 and outside the plate-shaped body 38*i* of the second needle receiving member 38, respectively. The threading mechanism 42 is always urged by the first biasing member 50 in such a manner that the protrusions 44*d*, 46*d* of the first and second holding members 44, 46 of the threading mechanism 42 are spaced away from the receiving portions 36*s*, 38*s* of the needle receiving mechanism 34. When the threading mechanism 42 is operated so as to be pivoted in a direction in which the threading mechanism 42 approaches the needle receiving mechanism 34 against the action of the first biasing member 50 as will be discussed in greater detail hereinafter, the protrusion 44*d* of the first holding member 44 and the protrusion 46*d* of the second holding member 46 approach the receiving portion 36*s* of the first needle receiving member 36 and the receiving portion 38*s* of the second needle receiving member 38, respectively.

Moreover, the plate-shaped body 36*i* of the first needle receiving member 36 has a stopper protrusion (not shown) provided on the outer surface thereof and the plate-shaped body 38*i* of the second needle receiving member 38 also has a stopper protrusion 38*p* provided on the outer surface thereof. Similarly, the plate-shaped body of the first holding member 44 has a stopper protrusion 44*e* provided on the inner surface thereof and the plate-shaped body of the second holding member 46 also has a stopper protrusion 46*e* provided on the inner surface thereof. Though the threading mechanism 42 is urged by the first biasing member 50 in such a manner that the protrusions 44*d*, 46*d* thereof are spaced away from the receiving portions 36*s*, 38*s* of the needle receiving mechanism 34 as discussed above, the stopper protrusion 44*e* of the first holding member 44 and the stopper protrusion 46*e* of the second holding member 44 are engagedly abutted against the stopper protrusion (not shown) of the first needle receiving member 36 and the stopper protrusion 38*p* of the second needle receiving member 38, respectively, whereby further pivotal movement of the threading mechanism 42 in the direction spaced away from the needle receiving mechanism 34 is prevented.

Incidentally, a position at which the threading mechanism 42 is spaced away from the needle receiving mechanism 34 to its fullest extent will be hereinafter referred to as "a first position". Moreover, a position at which the threading mechanism 42 is pivoted to a position approaching the needle receiving mechanism 34 to its fullest extent against the action of the first biasing member 50 will be hereinafter referred to as "a second position". When the threading mechanism 42 is pivoted to the second position, the protrusions 44*d*, 46*d* of the first and second holding members 44, 46 approach the receiving portions 36*s*, 38*s* of the needle receiving mechanism 34.

When the threading mechanism 42 is pivoted between the first and second positions, the threader pin 48*b* of the threading mechanism 42 can be reciprocatingly moved between the above-mentioned clearance between the opposed surfaces of the receiving portions 36*s*, 38*s* of the first and second needle receiving members 36, 38, and the through-hole 34*g*, via a communicating portion between the needle insertion hole 34*c* and the thread insertion slit 34*e*, while being moved in the first slit 52*c* and second slit 52*e* of the protective cover 52.

Figure 16:
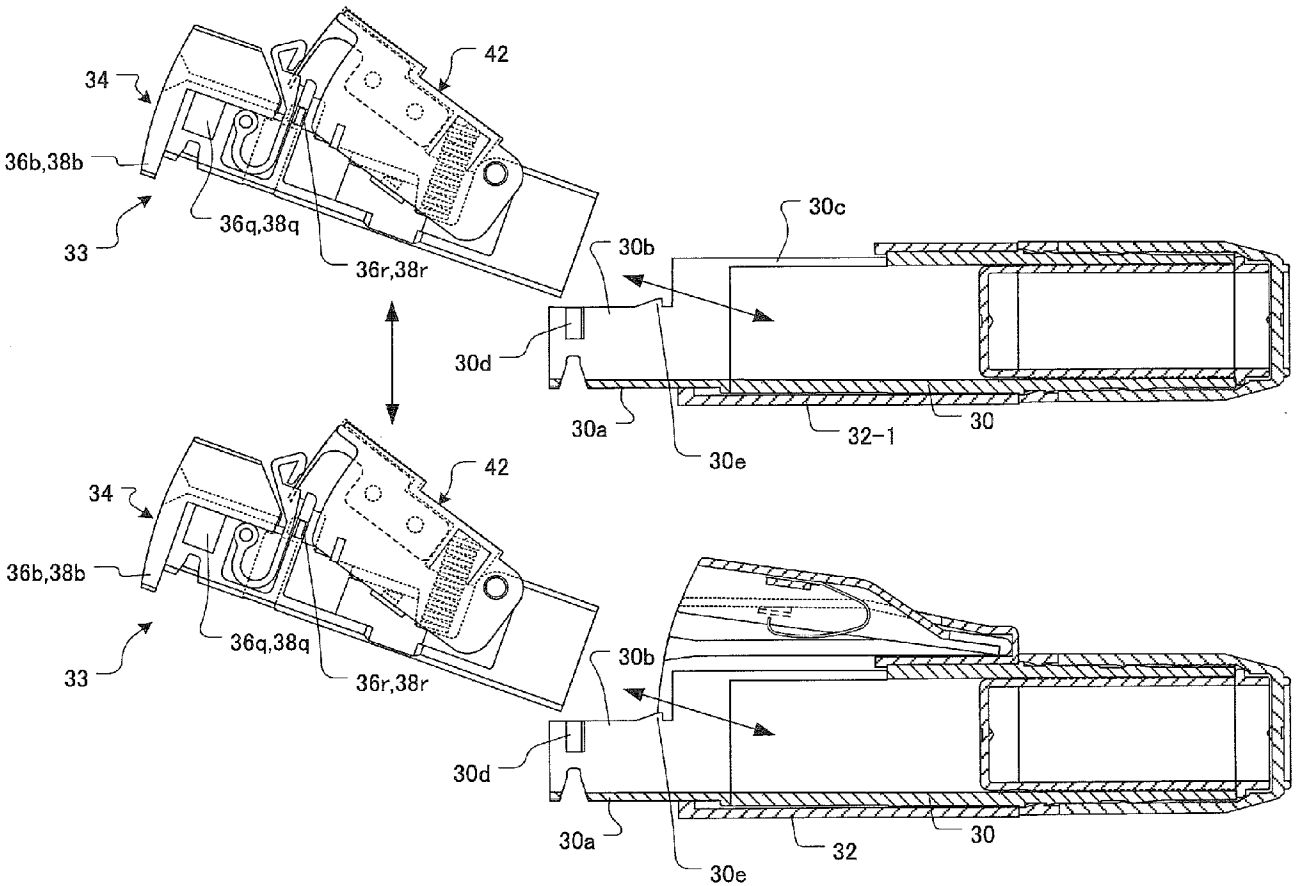
FIG. 16 is a schematic explanatory view for explaining a case where the internal mechanism unit is housed in a body at which the cover without the threader pin-breakage preventing function is provided, or a case where the internal mechanism is housed in the body of FIG. 6 at which an operation unit having the threader pin-breakage preventing function is provided.

The internal mechanism unit 33 which comprises the needle receiving mechanism 34 and the threading mechanism 42 is inserted in the body 30 through the opening portion 30*b* of the elongated section 30*a* of the body 30 and the axially extending opening portion 30*c* of the body 30 as shown in FIG. 16. At this time, the engaging recess portions 36*q*, 38*q* of the needle receiving members 36, 38 are engaged with the engaging protrusions 30*d* of the body 30, the engagement protrusions 36*r*, 38*r* of the needle receiving members 36, 38 are engaged with the engaging protrusions 30*e* of the body 30, and the flange portions 36*b*, 38*b* of the needle receiving members 36, 38 are engagedly abutted against the tip end surface of the elongated section 30*a* of the body 30, whereby the internal mechanism unit 33 is attached to the body 30 so as not to be easily removed from the body 30.

Figure 7:
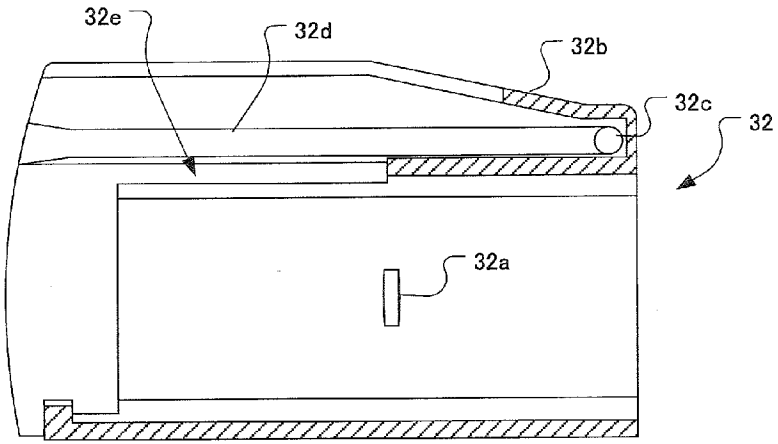
FIG. 7 is a schematic longitudinal sectional view of a cover of the needle threading device shown in FIG. 1.

The operation unit briefly discussed above is adapted to be detachably attached to the needle threading device 10 and comprises the cover 32 briefly discussed above, an operating member 54 (see FIGS. 2 and 3), and a spring (a second biasing member) 56 (see FIGS. 2 and 3). The cover 32 is detachably mounted around the body 30 so as to encircle the internal mechanism unit 33 and the body 30. The cover 32 is adapted to be slidable between a position at which, as shown in FIGS. 2 and 3, it covers the threading mechanism 42 exposed from the opening portion 30*b* of the elongated section 30*a* and the axially extending opening portion 30*c* of the body 30 and causes the threading mechanism 42 to be constrained in the second position (hereinafter referred to as "a constraint position"), and a position at which, as shown in FIG. 9, it causes the elongated section 30*a* and a tip end portion of the threading mechanism 42 to be exposed and allows the pivotal movement of the threading mechanism 42 between the first and second positions (hereinafter referred to as "an allowance position"). In order that the cover 32 is stopped at the constraint position and the allowance position with respect to the body 30, engagement protrusions 32*a* are provided on inner surfaces of side plates of the cover 32 (only an engagement protrusion 32*a* on an inner surface of one of the side plates of the cover 32 is shown in FIG. 7), and engagement protrusions 30*f* are provided on regions of outer surfaces of side plates of the body 30 which positionally correspond to the constraint position and the allowance position (only engagement protrusions 30*f* on an outer surface of one of the side plates of the body 30 are shown in FIGS. 4 and 6). The engagement protrusions 32*a* of the cover 32 are engagedly abutted against corresponding engagement protrusions 30*f* of the body 30 during the movement of the cover 32 with respect to the body 30, whereby the cover 32 is stopped at the constraint position or the allowance position with respect to the body 30 so as not to be easily moved from one of the constraint and allowance positions to the other of the constraint and allowance positions.

Figure 10:
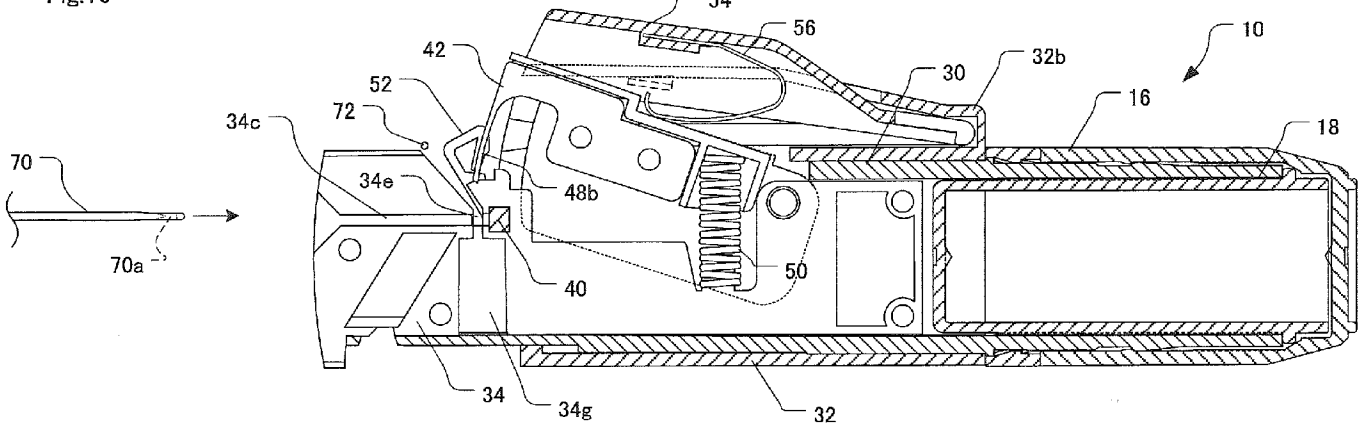
FIG. 10 is a schematic longitudinal sectional view of the needle threading device of FIG. 1 at the time when being used.
Figure 11:
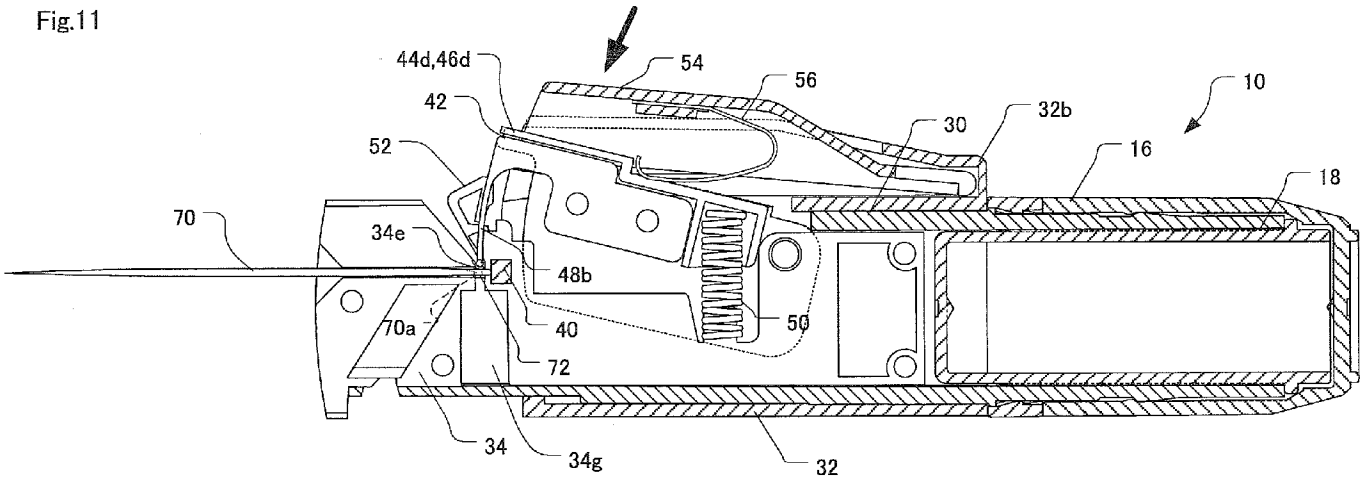
FIG. 11 is a schematic longitudinal sectional view of the needle threading device of FIG. 1 at the time when being used.

As shown in FIG. 7, the cover 32 has an axially extending opening portion 32*e* formed along a forward half region of an upper portion thereof and positionally corresponding to the axially extending opening portion 30*c* of the body 30. A portion of the threading mechanism 42 is adapted to be projected upward through the opening portion 32*e* of the cover 32 as shown in FIGS. 9-11. Moreover, the cover 32 is provided with an operating member-mounting portion 32*b* which is bulged upward as shown in FIGS. 4 and 7. The operating member-mounting portion 32*b* includes a pair of spaced apart side plates interposing the axially extending opening 32*e* of the cover 32 therebetween, and an upper plate interconnecting the pair of spaced apart side plates of the operating member-mounting portion 32*b*. The upper plate of the operating member-mounting portion 32*b* has an axially extending opening formed in a region thereof except a rear end portion thereof and arranged so as to positionally correspond to the opening portion 32*e* of the cover 32. Both side regions of the upper plate of the operating member-mounting portion 32*b* which interpose the axially extending opening of the operating member-mounting portion 32*b* therebetween are bent so as to be opposed to each other. The operating member-mounting portion 32*b* has pin receiving holes 32*c* formed in rear end portions of the spaced apart side plates thereof (only one pin receiving hole 32*c* is shown in FIGS. 4 and 7). Moreover, the operating member-mounting portion 32*b* has axially extending guide grooves 32*d* formed in inner surfaces of the spaced apart side plates thereof so as to extend to tip ends of the spaced apart side plates of the operating member-mounting portion 32*b* from the pin receiving holes 32*c* (only an axially extending guide groove 32*d* of one of the spaced apart side plates of the operating member-mounting portion 32*b* is shown in FIGS. 4 and 7).

Figure 8:
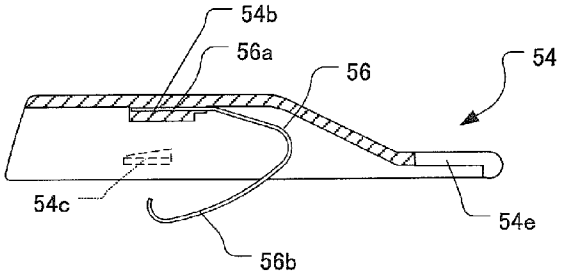
FIG. 8 is a schematic sectional view of an operating member of the needle threading device of FIG. 1 which has a second biasing member.

The operating member 54 is pivotally supported by the operating member-mounting portion 32*b* of the cover 32. As shown in FIGS. 4 and 8, the operating member 54 includes a pair of spaced apart side plates, an upper plate interconnecting the pair of spaced apart side plates of the operating member 54, and pins 54*a* projecting laterally from rear ends of the spaced apart side plates of the operating member 54. The pins 54*a* of the operating member 54 are fitted in the pin receiving holes 32*c* of the operating member-mounting portion 32*b*, whereby the operating member 54 is pivotally supported by the operating member-mounting portion 32*b* so as to be pivotable about the pins 54*a*. As shown in FIG. 4, an elongated slit 54*e* is formed in a region of the operating member 54 between the pins 54*a*. The fitting of the pins 54*a* of the operating member 54 into the pin receiving holes 32*c* of the operating member-mounting portion 32*b* is performed by inserting the pins 54*a* of the operating member 54 into the axially extending guide grooves 32*d* of the operating member-mounting portion 32*b* while causing a width of the slit 54*e* of the operating member 54 to be narrowed, and moving the operating member 54 relative to the operating member-mounting portion 32*b* until the pins 54*a* of the operating member 54 reach the pin receiving holes 32*c* of the operating member-mounting portion 32*b*, so that it is possible to easily attach the operating member 54 to the operating member-mounting portion 32*b*.

As shown in FIGS. 4 and 8, the spaced apart side plates of the operating member 54 have stopper protrusions 54*c* provided on outer surfaces thereof (only a stopper protrusion 54*c* provided on one of the outer surfaces of the spaced apart side plates of the operating member 54 is shown in FIGS. 4 and 8) for preventing removal of the operating member 54 from the cover 32. Moreover, the operating member 54 is provided on an inner surface of the upper plate thereof with a spring-mounting base 54*b* to which the spring (the second biasing member) 56 briefly discussed above is retained.

The spring 56 is a leaf spring that is formed into a substantially laterally-facing U-shape as viewed in a side view and comprises a first piece 56*a* and a second piece 56*b* continuously extending from one end of the first piece 56*a* at an angle relative to the first piece 56*a*. The other end of the first piece 56*a* of the spring 56 is retained to the spring-mounting base 54*b*. A free end portion of the second piece 56*b* of the spring 56 is contacted with an upper surface of the threading mechanism 42. The spring 56 is adapted to be elastically deformed in such a manner that the angle between the first and second pieces 56*a*, 56*b* can be varied. The second biasing member 56 always causes the operating member 54 and the threading mechanism 42 to be urged in a direction in which they are spaced away from each other.

In an unused condition of the needle threading device 10 according to the embodiment of the present invention, as shown in FIGS. 2 and 3, the needle threading unit 12 is brought into a state where the threading mechanism 42 thereof is positioned at the constraint position by the cover 32, and the portion of the threading mechanism 42 which is exposed from the opening portion 30*b* of the elongated section 30*a* and the axially extending opening portion 30*c* of the body 30 is covered by the cover 32 and the operating member 54. In the constraint position, the second piece 56*b* of the spring 56 is contacted with upper surfaces of the tip end portions of the protrusions 44*d*, 46*d* of the threading mechanism 42, so that a force exerted by the spring 56 overcomes a force exerted by the spring 50, and the threading mechanism 42 is constrained in the constraint position and maintained encircled together with the needle receiving mechanism 34 by the cover 32. The operating member 54 is brought into a state where it is partially projected from the axially extending opening of the operating member-mounting portion 32*b* of the cover 32 by the action of the spring 56, but is prevented from jumping up from the axially extending opening portion of the operating member-mounting portion 32*b* since the stopper protrusions 54*c* of the operating member 54 are engagedly stopped by the both side regions of the upper plate of the operating member-mounting portion 32*b* of the cover 32 which interpose the axially extending opening of the operating member-mounting portion 32*b* and are bent so as to be opposed to each other, as briefly discussed above.

In the state discussed above, as shown in FIG. 3, the threader pin 48*b* of the threading mechanism 42 is inserted through the second slit 52*e* of the head portion 52*b* of the protective cover 52 and the tip end portion of the threader pin 48*b* reaches the through-hole 34*g* of the needle receiving mechanism 34 through the clearance between the opposed surfaces of the receiving portions 36*s*, 38*s* of the needle receiving mechanism 34. The threader pin 48*b* is inserted through the second slit 52*e* of the protective cover 52, so that the threader pin 48*b* can be protected from any external force.

Referring now to FIGS. 9-13, the operation of inserting of a thread 72 into an eye 70*a* of a needle 70 which is performed by the needle threading device 10 according to the embodiment of the present invention will be discussed hereinafter. First, the user causes the cover 32 to be slid to the allowance position from the constraint position on the body 30 as shown in FIG. 9. According to such sliding movement of the cover 32, the second piece 56*b* of the spring 56 is slid on the protrusions 44*d*, 46*d* of the threading mechanism 42. As soon as the cover 32 reaches the allowance position, the threading mechanism 42 is released from the state constrained by the cover 32, and the force exerted by the spring 50 overcomes the force exerted by the spring 56, so that the threading mechanism 42 is pivoted toward the first position by the action of the spring 50. According to the pivotal movement of the threading mechanism 42 to the first position, the spring 56 is elastically deformed. Moreover, according to the pivotal movement of the threading mechanism 42 to the first position, the threader pin 48*b* of the threading mechanism 42 is moved in the first slit 52*c* and second slit 52*e* of the protective cover 52 and the clearance between the opposed surfaces of the receiving portions 36*s*, 38*s* of the needle receiving mechanism 34 in such a manner that the tip end portion thereof comes out of the through-hole 34*g* of the needle receiving mechanism 34. However, the threader pin 48*b* remains in the first slit 52*c* and second slit 52*e* of the protective cover 52, so that the threader pin 48*b* is still protected from any external force. Moreover, the stopper protrusion 44*e* of the first holding member 44 and the stopper protrusion 46*e* of the second holding member 46 are abutted against the unshown stopper protrusion of the first needle receiving member 36 and the stopper protrusion 38*p* of the second needle receiving member 38, respectively.

Next, as shown in FIG. 10, the user inserts the needle 70 into the needle insertion hole 34*c* of the needle receiving mechanism 34 while orienting one end of the needle 70, that has the eye 70*a*, to the needle insertion hole 34*c*. When the end of the needle 70 reaches the rear end (an innermost) of the needle insertion hole 34*c*, the needle 70 is attracted toward the magnet 40 arranged adjacently to the innermost of the needle insertion hole 34*c*, so that the needle 70 positively remains in the needle insertion hole 34*c* and can be prevented from coming out of the needle insertion hole 34*c*. Incidentally, the needle insertion hole 34*c* is formed so as to have a length shorter than that of the needle 70. Therefore, in the state where the end of the needle 70 reaches the innermost of the needle insertion hole 34*c*, the other end of the needle 70 is projected out of the needle insertion hole 34*c*, so that after the thread 72 has been inserted through the eye 70*a* of the needle 70 by the needle threading device 10 according to the embodiment of the present invention, the user can easily pull the needle 70 having the thread 72 out of the needle insertion hole 34*c* while picking the other end of the needle 70 with his/her fingers.

Next, the user inserts the thread 72 into the thread insertion slit 34*e* of the needle receiving mechanism 34 through the clearance between the slanted surfaces 36*t*, 38*t* of the protruding portions 36*d*, 38*d* of the needle receiving members 36, 38 and the head portion 52*b* of the protective cover 52. The thread insertion slit 34*e* extends perpendicularly to the needle insertion hole 34*c* and communicates with the needle insertion hole 34*c*, so that the user can easily insert the thread 72 up to the region of the thread insertion slit 34*e* that communicates with the needle insertion hole 34*c*.

Figure 12:
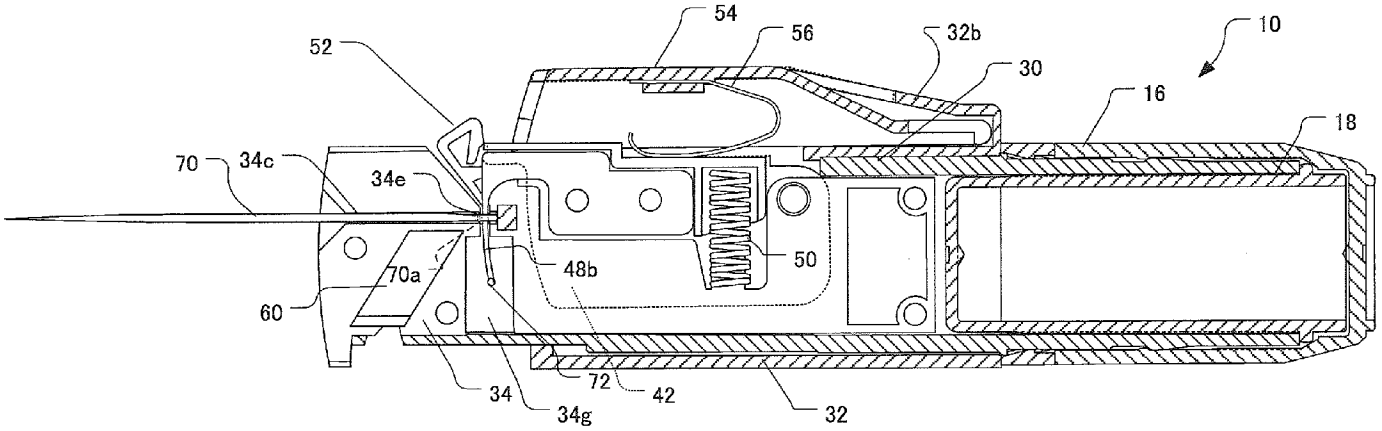
FIG. 12 is a schematic longitudinal sectional view of the needle threading device of FIG. 1 at the time when being used.

In the state where the needle 70 and the thread 72 are set in the needle receiving mechanism 34 as discussed above, when the user pushes the operating member 54 in such a manner to cause the operating member 54 to be pivoted in a direction approaching the threading mechanism 42 as shown in FIG. 11, the threading mechanism 42 is indirectly pushed via the spring 56 by the operating member 54 and pivoted to the second position against the action of the spring 50, and the protrusions 44*d*, 46*d* of the holding members 44, 46 approach the receiving portions 36*s*, 38*s* of the needle receiving mechanism 34. At this time, if the eye 70*a* of the needle 70 is located in position in the needle insertion hole 34*c*, according to the pivotal movement of the threading mechanism 42 to the second position, the tip end portion of the threader pin 48*b* of the threading mechanism 42 can pass through the eye 70*a* of the needle 70 while causing a portion of the thread 72 to be inserted through the eye 70*a* of the needle 70 in such a manner that the portion of the thread 72 is brought into a loop-shaped state, and the tip end portion of the threader pin 48*b* then enters the through-hole 34*g* of the needle receiving mechanism 34, as shown in FIG. 12. When the operating member 54 is released from the state where it has been pushed by the user, the threading mechanism 42 is pivoted to the first position by the action of the spring 50. According to the pivotal movement of the threading mechanism 42 to the first position, the threader pin 48*b* comes out of the through-hole 34*g* of the needle receiving mechanism 34 and the eye 70*a* of the needle 70 while allowing the portion of the thread 72 to be left passed through the eye 70*a* of the needle 70.

According to the pivotal movement of the threading mechanism 42 to the first position, the threader pin 48*b* is moved relative to the first slit 52*c* and second slit 52*e* of the head portion 52*b* of the protective cover 52 but still remains in the first slit 52*c* and second slit 52*e* of the protective cover 52, so that the threader pin 48*b* is prevented from being elastically deformed and can be prevented from being bent and/or broken.

Figure 13:
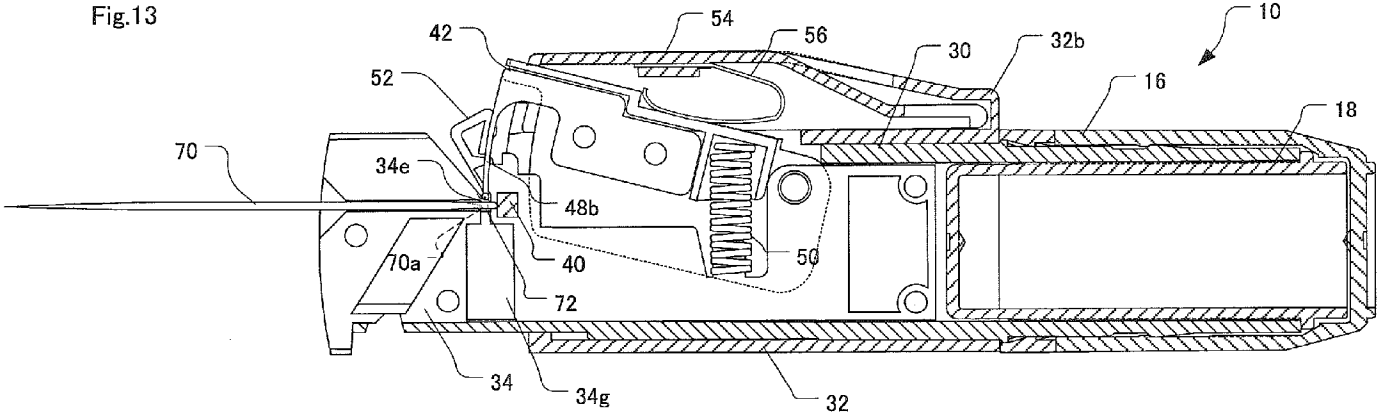
FIG. 13 is a schematic longitudinal sectional view of the needle threading device of FIG. 1 at the time when being used.

On the other hand, in a state where the eye 70*a* of the needle 70 in the needle insertion hole 34*c* is not located correctly relative to the thread insertion slit 34*e*, when the operation member 54 is pushed by the user, thereby causing the threading mechanism 42 to be pivoted to the second position, the threader pin 48*b* approaches the needle 70 according to the pivotal movement of the threading mechanism 42 to the second position and is then abutted against a portion of the needle 70 other than the eye 70*a* of the needle 70. In each of the needle threading devices in accordance with the related art, if the threading mechanism is forcedly operated by the user in the above-mentioned situation, the threader pin cannot withstand a load that has been applied to the threader pin by the abutting of the threader pin against the portion of the needle, resulting in that the threader pin will be bent and/or broken. However, in the needle threading device 10 according to the embodiment of the present invention, when the user continues to push the operating member 54 in the state where the threader pin 48*b* of the threading mechanism 42 is abutted against the portion of the needle 70 as shown in FIG. 13, though the operating member 54 is pivoted in the direction approaching the threading mechanism 42 while causing the spring 56 to be deformed, the threading mechanism 42 is not further pivoted since the load that has been applied to the threader pin 48*b* by the abutting of the threader pin 48*b* against the portion of the needle 70 is absorbed by the deformation of the spring 56, so that it is possible to prevent the threader pin 48*b* from being bent and/or broken.

Incidentally, when the eye 70*a* of the needle 70 in the needle insertion hole 34*c* is not located correctly relative to the thread insertion slit 34*e*, the position of the eye 70*a* of the needle 70 in the needle insertion hole 34*c* can be corrected by rotating the needle 70 or by once pulling the needle 70 out of the needle insertion hole 34*c* and then reinserting the needle 70 into the needle insertion hole 34*c*.

Figure 14:
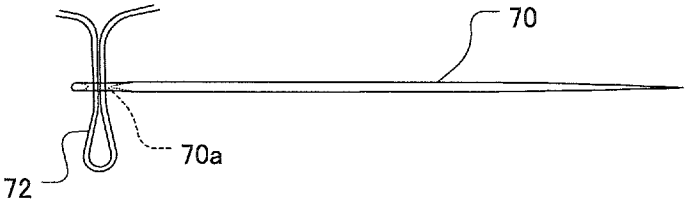
FIG. 14 is a schematic view showing a needle through whose eye a thread has been inserted by the needle threading device shown in FIG. 1.

After the portion of the thread 72 has been inserted through the eye 70*a* of the needle 70, the needle 70 through whose eye 70*a* the portion of the thread 72 has been inserted in the loop-shaped state as shown in FIG. 14 is pulled out of the needle insertion hole 34*c* by the user. Thereafter, the user can cause the portion of the thread 72 from the loop-shaped state while making the loop-shaped portion of the thread 72 broader.

After the use of the needle threading device 10 according to the embodiment of the present invention is finished, the cover 32 is moved to the constraint position from the allowance position by the user, whereby the portion of threading mechanism 42 which is exposed from the opening portion 30*b* of the elongated section 30*a* and the axially extending opening portion 30*c* of the body 30 is again covered by the cover 32 and the operating member 54. As the cover 32 is returned to the constraint position, the second piece 56*b* of the spring 56 is slid on the protrusions 44*d*, 46*d* of the holding members 44, 46, the threading mechanism 42 is pivoted to the second position, and the protrusions 44*d*, 46*d* of the holding members 44, 46 approach the needle receiving mechanism 34 according to the pivotal movement of the threading mechanism 42 to the second position.

As discussed above, according to the present invention, it is possible to prevent the breakage of the threader pin 48*b*, thus making it possible to enhance the durability of the needle threading device 10.

The needle threading device 10 according to the embodiment of the present invention includes the cover 32 which has the threader pin-breakage preventing function and is adapted to be detachably attached to the body 30, so that an exchange between the cover 32 and a cover without the threader pin-breakage preventing function is made, thereby making it possible to easily change the presence/absence of the threader pin-breakage preventing function. More particularly, the operation unit according to the present invention which comprises the cover 32, the operating member 54, and the spring 56 and has the threader pin-breakage preventing function is adapted to be detachably attached to the body 30 in which the internal mechanism unit 33 is housed. A cover with which a needle threading device is provided and which does not have the threader pin-breakage preventing function is replaced with the operation unit according to the present invention having the threader pin-breakage preventing function, thereby making it possible to additionally give the threader pin-breakage preventing function to the needle threading device. Vice versa is also possible.

Figure 15:
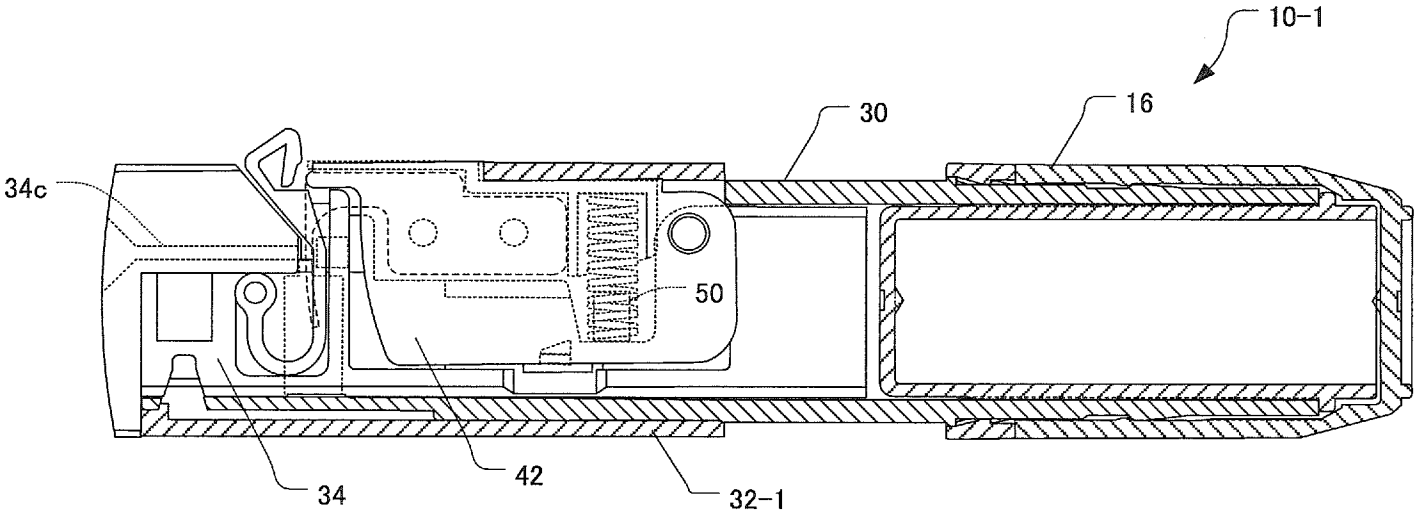
FIG. 15 is a schematic longitudinal sectional view of a needle threading device provided with a cover that does not has a threader pin-breakage preventing function.

Referring to FIG. 15, there is illustrated a needle threading device 10-1 without the threader pin-breakage preventing function. Incidentally, components of the needle threading device 10-1 which are substantially same to those of the needle threading device 10 shown in FIGS. 1-13 are designated with like reference signs and the description of them will not be repeated. If the needle threading device 10-1 without the threader pin-breakage preventing function is intended to be employed, a cover 32-1 which is equivalent to the cover 32 except without the operating member-mounting portion 32*b*, the operating member 54, and the spring 56 is used. If the threader pin-breakage preventing function is intended to be given to the needle threading device 10-1, the cover 32-1 is replaced with the operation unit according to the present invention, thereby making it possible to give the threader pin-breakage preventing function to the needle threading device 10-1 without changing the components except for the cover 32-1.

The replacement of the cover 32-1 of the needle threading device 10-1 shown in FIG. 15 with the operation unit according to the present invention can be performed as will be discussed hereinafter. First, the cover 32-1 is moved to the allowance position from the constraint position on the body 30, and the internal mechanism unit 33 which comprises the needle receiving mechanism 34 and the threading mechanism 42 is removed from the body 30 through the axially extending opening portion 30*c* of the body 30 and the opening portion 30*b* of the elongated section 30*a*. At this time, if the internal mechanism unit 33 is picked up in an obliquely upward direction from the body 30 as shown in FIG. 16, the engagement between the engagement protrusions 36*r*, 38*r* of the first and second needle receiving members 36, 38 and the engaging protrusions 30*e* of the body 30 can be released, thus making it possible to easily remove the internal mechanism unit 33 from the body 30. Then, the cover 32-1 is drawn toward a tip end direction of the body 30 and the engagement between the engagement protrusions 30*f* of the body 30 and the engagement protrusions 32*a* of the cover 32-1 is released, whereby the cover 32-1 can be easily removed from the body 30. Next, the operation unit which comprises the cover 32, the operating member 54, and the spring 56 is attached to the body 30 and the internal mechanism unit 33 is then inserted into the body 30, whereby it is possible to give the threader pin-breakage preventing function to the needle threading device 10-1. It is possible to return the needle threading device 10-1 to the needle threading device without the threader pin-breakage preventing function in reverse order.

Incidentally, the internal mechanism unit 33 itself has a threading function, so that the internal mechanism unit 33 is removed from the body 30 and can be independently used in order to insert the thread 72 into the eye 70*a* of the needle 70.

The terms and expressions that have been employed are employed only for describing and do not limit the contents of the present invention. There is no intention in the use of such terms and expressions to exclude any equivalents of the features described or any portions thereof. It is recognized, however, that various modifications are possible within the scope of the invention claimed.

What is claimed is:

1. A needle threading device comprising:

a needle receiving mechanism having a needle insertion hole for receiving a needle therein and a thread insertion slit for receiving a thread therein;

the thread insertion slit extending at an angle relative to the needle insertion hole and communicating with the needle insertion hole;

a threading mechanism provided with a threader pin and pivotally supported by the needle receiving mechanism so as to be pivotable between a first position and a second position different from the first position;

the threader pin enabling the thread in the thread insertion slit to pass through an eye of the needle in the needle insertion hole when the threading mechanism is pivoted to the second position from the first position;

a cover provided so as to be movable with respect to the needle receiving mechanism and encircling at least partially the needle receiving mechanism;

a first biasing member urging the threading mechanism to the first position;

an operating member attached to the cover for causing the threading mechanism to be pivoted to the second position against an action of the first biasing member; and a second biasing member urging the operating member and the threading mechanism in a direction in which they are spaced away from each other;

wherein when the operating member is operated so as to be moved in a direction in which it approaches the threading mechanism, the threading mechanism is pushed by an action of the second biasing member to be pivoted to the second position against the action of the first biasing member; and when the threading mechanism is pivoted toward the second position and the threader pin is abutted against the needle in the needle insertion hole, the pivotal movement of the threading mechanism to the second position is stopped and the operating member approaches the threading mechanism against the action of the second biasing member.

2. The needle threading device according to claim 1, wherein the cover is adapted to be movable between a constraint position in which it causes the threading mechanism to be constrained in the second position, and an allowance position in which it allows the threading mechanism to be pivoted between the first and second positions, and when the cover is moved to the allowance position from the constraint position, the second biasing member is adapted to be slid on the threading mechanism according to the movement of the cover to the allowance position from the constraint position.

3. The needle threading device according to claim 2, wherein when the cover is moved to the allowance position, the threading mechanism is pivoted toward the first position by the action of the first biasing member and the second biasing member is elastically deformed according to the pivotal movement of the threading mechanism toward the first position.

4. The needle threading device according to claim 2, further including a body, the needle receiving mechanism and the threading mechanism being housed in the body so as to be removable from the body, and the cover being detachably mounted on the body so as to be movable between the constraint position and the allowance position.

5. The needle threading device according to claim 3, further including a body, the needle receiving mechanism and the threading mechanism being removably housed in the body, and the cover being detachably mounted on the body so as to be movable between the constraint position and the allowance position.

6. An operation unit adapted to be detachably attached to a needle threading device;

the needle threading device comprising:

a needle receiving mechanism having a needle insertion hole for receiving a needle therein and a thread insertion slit for receiving a thread therein;

the thread insertion slit extending at an angle relative to the needle insertion hole and communicating with the needle insertion hole;

a threading mechanism provided with a threader pin and pivotally supported by the needle receiving mechanism so as to be pivotable between a first position and a second position different from the first position;

the threader pin enabling the thread in the thread insertion slit to pass through an eye of the needle in the needle insertion hole when the threading mechanism is pivoted to the second position from the first position; and a first biasing member urging the threading mechanism to the first position;

the operating unit comprising:

a cover adapted to be detachably attached to the needle threading device so as to be movable with respect to the needle receiving mechanism to encircle at least partially the needle receiving mechanism;

an operating member attached to the cover for causing the threading mechanism to be pivoted to the second position against an action of the first biasing member; and a second biasing member urging the operating member and the threading mechanism in a direction in which they are spaced away from each other;

wherein when the operating member is operated so as to be moved in a direction in which it approaches the threading mechanism, the threading mechanism is pushed by an action of the second biasing member to be pivoted to the second position against the action of the first biasing member; and when the threading mechanism is pivoted toward the second position and the threader pin is abutted against the needle in the needle insertion hole, the pivotal movement of the threading mechanism to the second position is stopped and the operating member approaches the threading mechanism against the action of the second biasing member.

7. The operation unit according to claim 6, wherein the cover is adapted to be movable between a constraint position in which the cover causes the threading mechanism to be constrained in the second position, and an allowance position in which the cover allows the threading mechanism to be pivoted between the first and second positions, and when the cover is moved to the allowance position from the constraint position, the second biasing member is adapted to be slid on the threading mechanism according to the movement of the cover to the allowance position from the constraint position.

8. The operation unit according to claim 7, wherein when the cover is moved to the allowance position, the threading mechanism is pivoted toward the first position by the action of the first biasing member and the second biasing member is elastically deformed according to the pivotal movement of the threading mechanism toward the first position.

9. The operation unit according to claim 7, wherein the needle threading device further includes a body, the needle receiving mechanism and the threading mechanism being removably housed in the body, and the cover being adapted to be detachably mounted on the body so as to be movable between the constraint position and the allowance position.

10. The operation unit according to claim 8, wherein the needle threading device further includes a body, the needle receiving mechanism and the threading mechanism being removably housed in the body, and the cover being adapted to be detachably mounted on the body so as to be movable between the constraint position and the allowance position.

* * * * *